US010249187B2

(12) United States Patent
Kamiya et al.

(10) Patent No.: US 10,249,187 B2
(45) Date of Patent: Apr. 2, 2019

(54) CONTROL SERVER AND CONTROL SYSTEM FOR CONTROLLING TRAFFIC SIGNALS BASED ON INFORMATION FROM PRESSURE SENSORS PLACED ON A ROADWAY

(71) Applicant: Kabushiki Kaisha Nihon Micronics, Tokyo (JP)

(72) Inventors: Hiroshi Kamiya, Aomori (JP); Kenji Sasaki, Aomori (JP); Osamu Arai, Tokyo (JP)

(73) Assignee: Kabushiki Kaisha Nihon Micronics, Musashino-shi, Tokyo (JP)

( * ) Notice: Subject to any disclaimer, the term of this patent is extended or adjusted under 35 U.S.C. 154(b) by 0 days.

(21) Appl. No.: 15/788,592

(22) Filed: Oct. 19, 2017

(65) Prior Publication Data

US 2018/0122233 A1 May 3, 2018

(30) Foreign Application Priority Data

Oct. 27, 2016 (JP) ..... 2016-210265

(51) Int. Cl.
*G08G 1/01* (2006.01)
*G08G 1/02* (2006.01)
(Continued)

(52) U.S. Cl.
CPC ..... *G08G 1/081* (2013.01); *G08G 1/0116* (2013.01); *G08G 1/0145* (2013.01); *G08G 1/02* (2013.01); *G08G 1/08* (2013.01)

(58) Field of Classification Search
CPC .. G01C 21/34; G05D 1/0214; G06K 9/00825; G08G 1/07; G08G 1/081;
(Continued)

(56) References Cited

U.S. PATENT DOCUMENTS 2,213,409 A * 9/1940 Quilliam ..... G08G 1/08 200/86 R
9,805,601 B1 * 10/2017 Fields ..... G08G 1/096791
(Continued)

FOREIGN PATENT DOCUMENTS

JP 2015-76046 4/2015

*Primary Examiner* — Quan-Zhen Wang
*Assistant Examiner* — Stephen R Burgdorf
(74) *Attorney, Agent, or Firm* — Lorenz & Kopf, LLP

(57) ABSTRACT

Provided are a control server and a control system both capable of preventing traffic accidents more effectively. The control server is configured to control multiple traffic signals installed on a road, and includes: a pressure information obtainer configured to obtain pressure information which is outputted from a pressure sensor installed at a stop position on the road corresponding to each of the multiple traffic signals, and which includes a value representing pressure received from a vehicle running on the road; an abrupt braking information obtainer configured to, based on the pressure information, obtain abrupt braking information on an abrupt braking operation performed by the vehicle running on the road; and a traffic signal controller configured to, based on the abrupt braking information, generate a control signal for controlling the multiple traffic signals.

3 Claims, 7 Drawing Sheets

(51) Int. Cl.
*G08G 1/08* (2006.01)
*G08G 1/081* (2006.01)

(58) Field of Classification Search
CPC ..... G08G 1/095; G08G 1/0962; G08G 1/096716; G08G 1/096775; G08G 1/096783; G08G 1/096791; G08G 1/164; G08G 1/166; H04W 4/046
USPC ..... 340/910
See application file for complete search history.

(56) References Cited

U.S. PATENT DOCUMENTS

2005/0156757 A1* 7/2005 Garner ..... G08G 1/095 340/907
2007/0250240 A1* 10/2007 Reisner ..... B60T 7/18 701/70
2009/0284395 A1* 11/2009 Bushman ..... G08G 1/08 340/907
2014/0307087 A1* 10/2014 Evanitsky ..... G08G 1/164 348/143
2018/0152517 A1* 5/2018 Zhong ..... H04L 12/66

* cited by examiner

FIG. 3

T1

| 301 AREA ID | 302 AREA RANGE [COORDINATES OF CENTER: RADIUS] | 303 NUMBER OF ACCIDENTS |
|---|---|---|
| A1 | (a31,b31) : 20m | 2 |
| A2 | (a32,b32) : 15m | 5 |
| A3 | (a33,b33) : 10m | 7 |
| A4 | (a34,b34) : 8m | 2 |
| ⋮ | ⋮ | ⋮ |

FIG. 4

T2

| 401 TRAFFIC SIGNAL ID | 402 AREA ID | 403 SET OF TRAFFIC SIGNAL POSITION INFORMATION (LATITUDE, LONGITUDE) | 404 ROAD ID | 405 GROUP ID | 406 SENSOR ID | 407 CONTROL MODE |
|---|---|---|---|---|---|---|
| 11 | A1 | (a11 , b11) | L1 | C1 | 21 | A |
| 12 | A2 | (a12, b12) | L2 | C2 | 22 | B |
| 13 | A2 | (a13, b13) | L2 | C2 | 23 | B |
| 14 | A3 | (a14 ,b14) | L2 | C3 | 24 | A |
| 15 | A4 | (a14 ,b14) | L4 | C4 | 25 | C |
| ⋮ | ⋮ | ⋮ | ⋮ | ⋮ | ⋮ | ⋮ |

FIG. 5

T3

| 501 SENSOR ID | 502 SET OF SENSOR POSITION INFORMATION (LATITUDE, LONGITUDE) | 503 ROAD ID |
|---|---|---|
| 21 | (a21 , b21) | L1 |
| 22 | (a22 , b22) | L2 |
| 23 | (a23 , b23) | L2 |
| 24 | (a24 , b24) | L3 |
| 25 | (a25 , b25) | L4 |
| ⋮ | ⋮ | ⋮ |

| 301 AREA ID | 302 AREA RANGE [COORDINATES OF CENTER: RADIUS] | 303 NUMBER OF ACCIDENTS | 304 TIMING | |
|---|---|---|---|---|
| | | | 304a MONTHS | 304b HOURS |
| A1 | (a31,b31) : 20m | 2 | APRIL TO JUNE | 7 O'CLOCK TO 9 O'CLOCK |
| A2 | (a32,b32) : 15m | 5 | APRIL TO JUNE | 7 O'CLOCK TO 9 O'CLOCK |
| A3 | (a33,b33) : 10m | 7 | APRIL TO JUNE | 7 O'CLOCK TO 9 O'CLOCK |
| A4 | (a34,b34) : 8m | 2 | APRIL TO JUNE | 7 O'CLOCK TO 9 O'CLOCK |
| ⋮ | ⋮ | ⋮ | ⋮ | ⋮ |

T4

CONTROL SERVER AND CONTROL SYSTEM FOR CONTROLLING TRAFFIC SIGNALS BASED ON INFORMATION FROM PRESSURE SENSORS PLACED ON A ROADWAY

CROSS-REFERENCE TO PRIORITY APPLICATION

This application claims the benefit of, and priority to, Japanese patent application number 2016-210265, filed Oct. 27, 2016. The content of the referenced application is incorporated by reference herein.

TECHNICAL FIELD

Embodiments of the present invention relate to a control server and a control system both configured to control traffic signals installed on a road.

BACKGROUND

Control systems for controlling traffic signals installed on roads have been used such that the display operations of the controlled traffic signals help to prevent traffic accidents and to make traffic smoother.

Among such control systems is, for example, a control system proposed to control traffic signals based on information on how long vehicles are forced to wait before the traffic signals, information on the number of vehicles which are passing by the traffic signals, and the like (see Japanese Patent Application Publication No. 2015-76046, for example).

BRIEF SUMMARY

In recent years, meanwhile, a demand for traffic accident prevention has become increasingly stronger in order to achieve a more secure and safer road traffic society.

Indeed, the control system according to the conventional technique is configured to control traffic signals based on information on how long vehicles are forced to wait before the traffic signals, information on the number of vehicles which are passing by the traffic signals, and the like. It cannot be said, however, that the control system takes sufficient measures to prevent traffic accidents. Thus, the current situation is that there is a demand for further improvement to the control system.

The disclosed subject matter has been made in view of such a conventional problem. An object of the present invention is to provide a control server and a control system both capable of preventing traffic accidents more effectively than ever.

In order to achieve the above object, a first aspect of the control server according to the present invention is that the control server is configured to control multiple traffic signals installed on a road, and includes a controller, in which the controller functions as a pressure information obtainer configured to obtain pressure information which is outputted from a pressure sensor installed at a stop position on the road corresponding to each of multiple traffic signals, and which includes a value representing pressure received from a vehicle running on the road, and configured to store the pressure information in a storage unit, an abrupt braking information obtainer configured to, based on the pressure information stored in the storage unit, obtain abrupt braking information on an abrupt braking operation performed by the vehicle running on the road, and configured to store the abrupt braking information in the storage unit, and a traffic signal controller configured to, based on the abrupt braking information stored in the storage unit, generate a control signal for controlling multiple traffic signals.

A second aspect of the control server according to the present invention is that, according to the above aspect, the control server further includes an accident information storage unit configured to store the number of accidents which have occurred in the past in an area where multiple traffic signals are installed, in which the controller functions as the traffic signal controller to generate the control signal for controlling multiple traffic signals in a case where the number of accidents is equal to or greater than a predetermined value.

A third aspect of the control server according to the present invention is that, according to the above aspect, the accident information storage unit stores the number of accidents and timing of occurrence of the accidents in association with each other, and the controller functions as the traffic signal controller to generate the control signal for controlling multiple traffic signals in a case where the number of accidents stored in association with the timing corresponding to a current date and time is equal to or greater than the predetermined value.

An aspect of the control system according to the present invention is that the control system includes: a data server configured to obtain pressure information, which includes a value representing pressure received from a vehicle running on a road, from a pressure sensor installed in a stop position on the road corresponding to each of multiple traffic signals; and a control server configured to obtain the pressure information from the data server, based on the pressure information, obtain abrupt braking information on an abrupt braking operation performed by the vehicle running on the road, and based on the abrupt braking information, generate a control signal for controlling multiple traffic signals.

An aspect of the control system according to the present invention is that the control system is configured to control multiple traffic signals installed on a road, and includes: multiple pressure sensors installed at stop positions on the road corresponding to multiple traffic signals, and configured to output pressure information which includes a value representing pressure received from a vehicle running on the road; and a control server, in which the control server functions as a pressure information obtainer configured to obtain the pressure information, and to store the pressure information in a storage unit, an abrupt braking information obtainer configured to, based on the pressure information stored in the storage unit, obtain abrupt braking information on an abrupt braking operation performed by the vehicle running on the road, and configured to store the abrupt braking information in the storage unit, and a traffic signal controller configured to, based on the abrupt braking information stored in the storage unit, generate a control signal for controlling multiple traffic signals.

Embodiments of the present invention can provide the control server and the control system both capable of preventing traffic accidents more efficiently than ever.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures.

FIG. 3 illustrates an example of an accident information management table according to the first embodiment of the present invention;

FIG. 4 illustrates an example of a traffic signal management table according to the first embodiment of the present invention;

FIG. 5 illustrates an example of a sensor management table according to the first embodiment of the present invention;

DETAILED DESCRIPTION

Figure 1:
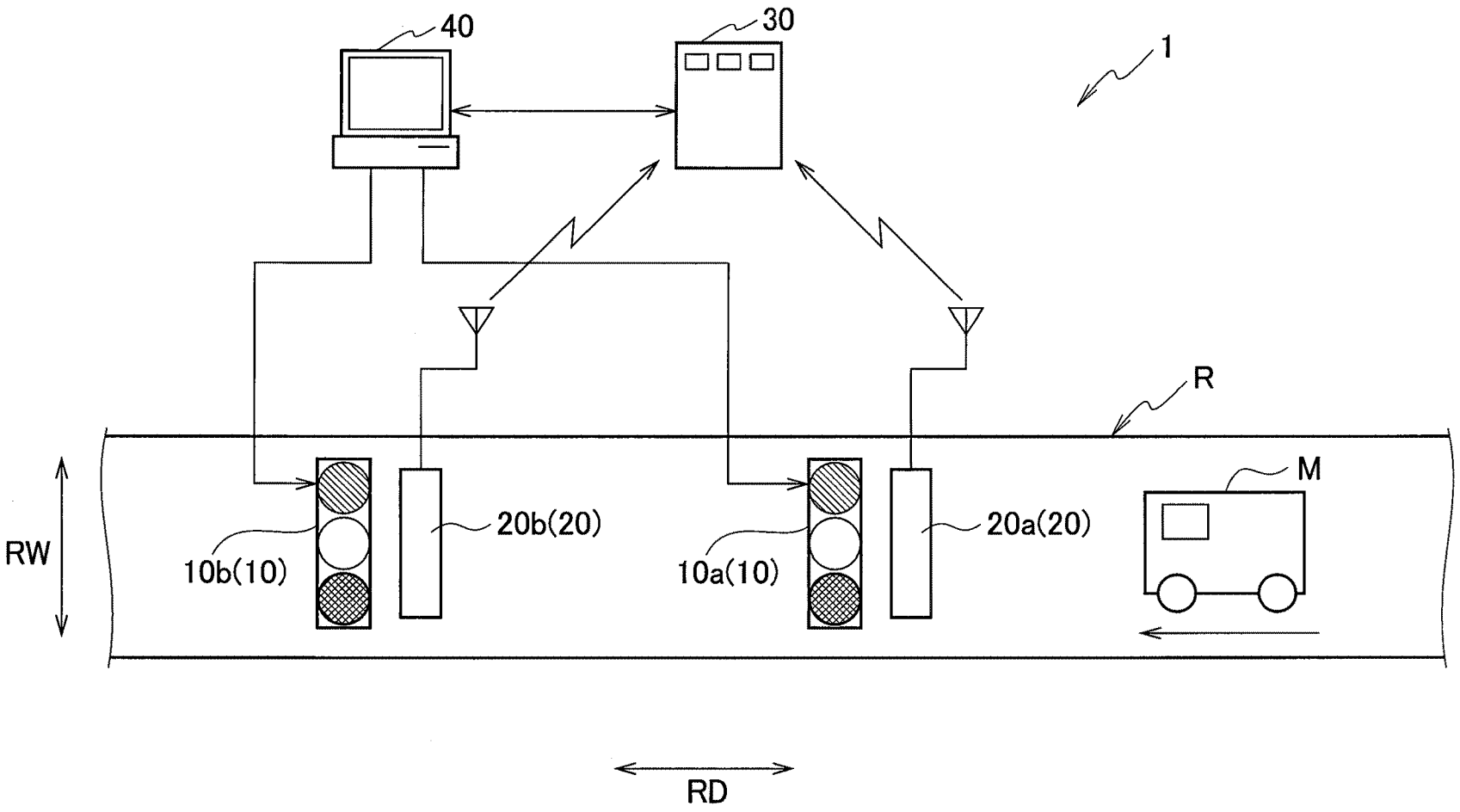
FIG. 1 is a schematic diagram for explaining a control system according to a first embodiment of the present invention.

Referring to the drawings, detailed descriptions will be hereinbelow provided for control systems according to embodiments of the present invention. Incidentally, the examples given below exemplify apparatuses and the like which embody the technical thoughts pertaining to the present invention, and are not intended to limit things, such as locations of various components, to ones discussed below. Various changes may be added to the technical thoughts pertaining to the present invention within the scope of the claims.

First Embodiment

Configuration of Control System

A control system 1 controls multiple traffic signals 10 installed on a road R. FIG. 1 is a schematic diagram of the control system 1 according to a first embodiment of the present invention. Incidentally, although FIG. 1 shows a case in which a vehicle M runs on the road R, it is a matter of course that a pedestrian, a bicycle and the like (none of which are illustrated) can run thereon. Furthermore, in FIG. 1, the left-right direction represents a running direction RD on the road R, and the up-down direction represents a road width direction RW. In addition, for the purpose of simplifying explanations, FIG. 1 shows the road R on which the vehicle M is allowed to run only in one direction (the leftward direction) of the running direction RD.

As illustrated in FIG. 1, the control system 1 includes the traffic signals 10, pressure sensors 20, a data server 30, and a control server 40.

Each traffic signal 10 performs a display operation of displaying a green signal for displaying green, a yellow signal for displaying yellow, and a red signal for displaying red in a green-yellow-red sequence. For example, the green signal allows traffic to proceed, and the red signal prohibits traffic. The yellow signal indicates a change from the green signal to the red signal, and warns that the traffic is about to be prohibited.

The traffic signals 10 include a traffic signal 10*a* and a traffic signal 10*b*. The traffic signal 10*a* and the traffic signal 10*b* are installed adjacent to each other on the road R. Incidentally, the traffic signal 10*a* and the traffic signal 10*b* will be hereinafter explained by being denoted simply as the traffic signals 10 depending on the necessity.

The pressure sensors 20 are installed on the road surface of the road R. The pressure sensors 20 are installed at stop positions on the road R, respectively, corresponding to the multiple traffic signals 10. Specifically, a pressure sensor 20*a* is installed at a stop position corresponding to the traffic signal 10*a*, and a pressure sensor 20*b* is installed at a stop position corresponding to the traffic signal 10*b*. Incidentally, the pressure sensor 20*a* and the pressure sensor 20*b* will be hereinafter explained by being denoted simply as the pressure sensors 20 depending on the necessity.

In this respect, each stop position is a position defined on the road surface of the road R, corresponding to the traffic signal 10, and requiring the vehicle M to stop there. For example, the stop position is an area where a vehicle stop line is formed. Incidentally, the stop position is not limited to the area where the vehicle stop line is formed. The stop position may be, for example, an area defined as having: a predetermined length to each of the front and back from the vehicle stop line in the running direction RD (for example, a total length of 4 m which includes 2 m to the front and 2 m to the back); and a width between the shoulders of the road R in the road width direction RW (for example, a width of 3.25 m).

Each pressure sensor 20 includes a piezoelectric element (not illustrated). The pressure sensor 20 measures a value representing a pressure received from the vehicle M running on the road R, and outputs pressure information including the pressure value. Specifically, the pressure sensor 20 converts the value representing the pressure received from the vehicle M into a voltage value, and outputs the pressure information including the thus-converted voltage value.

Figures 7, 8:
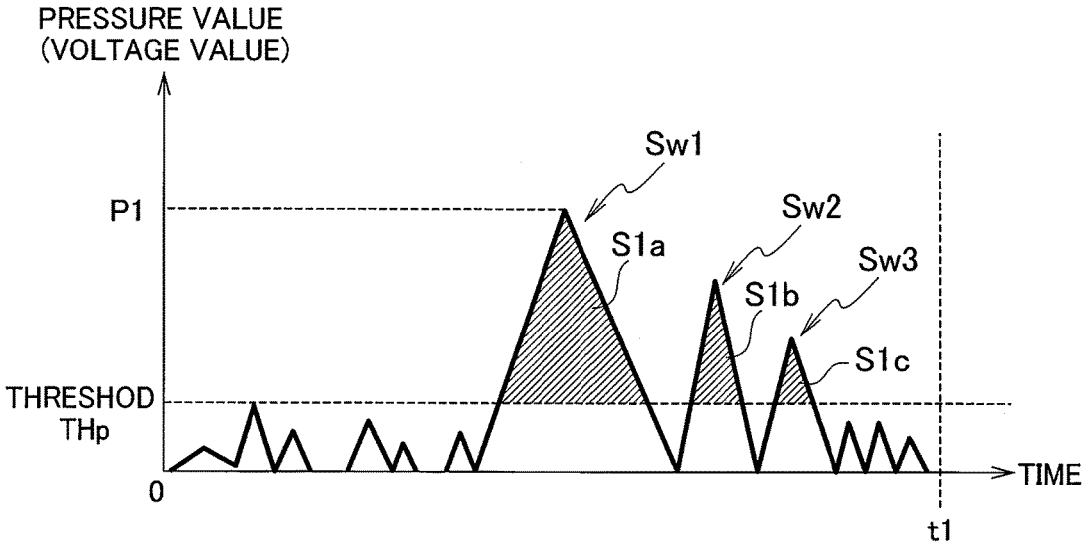
FIG. 7 is a diagram illustrating an example of pressure information according to the first embodiment.
FIG. 8 is a diagram illustrating an example of an accident information management table according to a modification of the first embodiment of the present invention.

The pressure information outputted from the pressure sensor 20 is information on changes in the pressure value over time, and is shown as pressure waveform data using: the voltage value converted from the pressure value; and time (see FIG. 7).

Furthermore, depending on an instruction from the data server 30, the pressure sensor 20 measures the pressure value, and sends the pressure value to the data server 30 via a communication unit such as an antenna.

The data server 30 collects various data on the control system 1, and stores the various collected data.

The control server 40 controls the entirety of the control system 1. The control server 40 controls the traffic signals 10 based on the various data stored in the data server 30.

Figure 2:
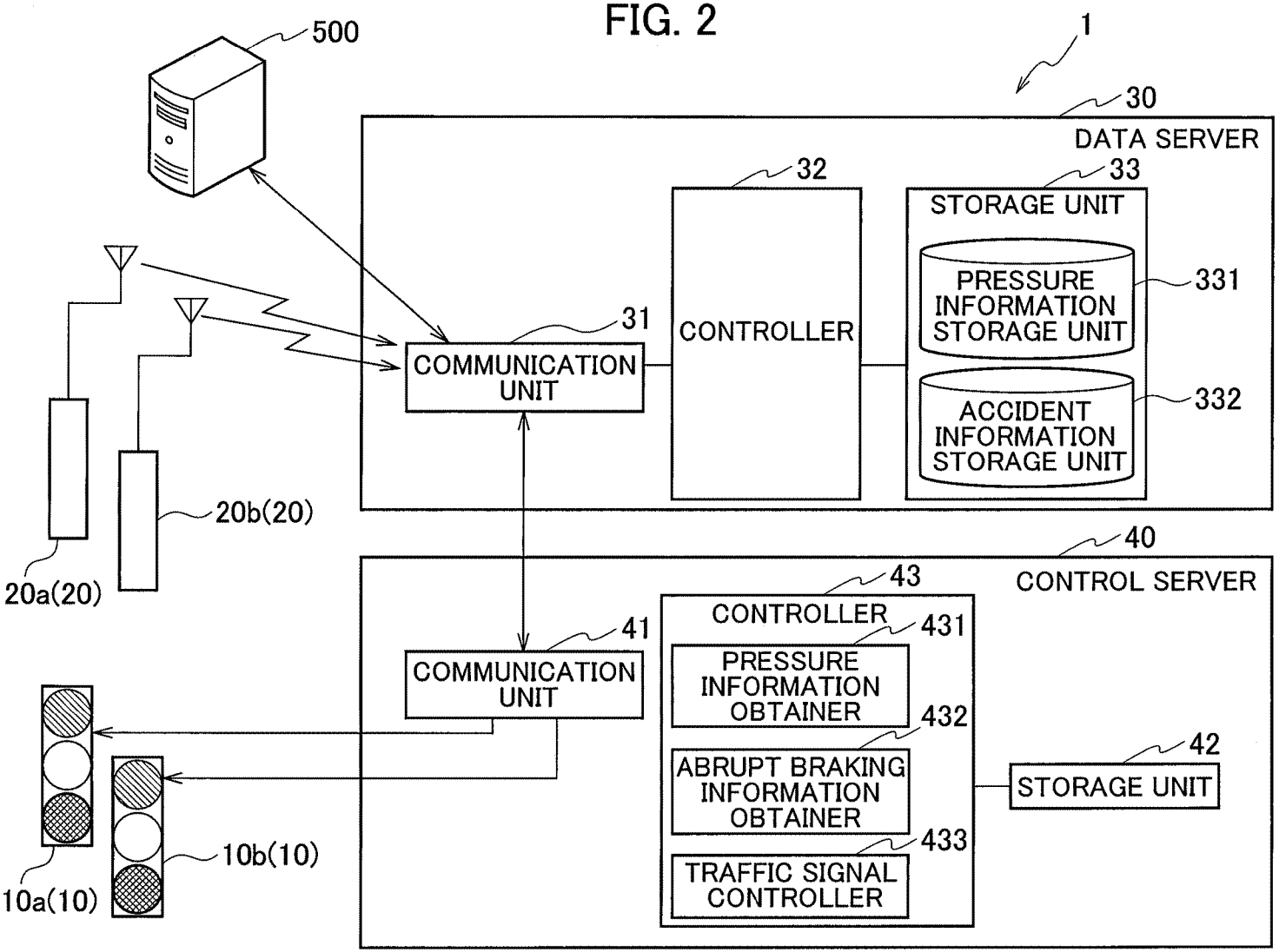
FIG. 2 is a block diagram illustrating functions of the control system according to the first embodiment of the present invention.

Next, referring to FIG. 2, specific descriptions will be provided for the configurations of the data server 30 and the control server 40. FIG. 2 is a block diagram illustrating functions of the control system 1.

As illustrated in FIG. 2, the data server 30 includes a communication unit 31, a controller 32 and the storage unit 33.

The communication unit 31 is a communication interface for the data server 30. The communication unit 31 sends and receives various sets of information to and from the pressure sensors 20 and the control server 40.

The controller 32 controls the operation of each unit in the data server 30. The controller 32 is configured including a CPU, a RAM, a ROM and the like. The controller 32 implements a control function using the CPU which reads a control program.

The controller 32 controls the pressure sensors 20. The controller 32 obtains the pressure information sent from each pressure sensor 20, and stores the obtained pressure information in the storage unit 33. Furthermore, the controller 32 obtains accident information from an external server 500 and the like via the communication unit 31, and stores the obtained accident information in the storage unit 33. Incidentally, details of the accident information will be described later (see FIG. 3). Moreover, based on an instruction from the control server 40, the controller 32 sends the pressure information and the accident information, both stored in the storage unit 33, to the control server 40.

The storage unit 33 is formed from a hard disk drive (HDD) and the like. The storage unit 33 stores various programs, as well as various sets of information and the like to be used when the data server 30 performs processes. In addition, the storage unit 33 includes a pressure information storage unit 331 and an accident information storage unit 332.

The pressure information storage unit 331 stores the pressure information. Specifically, the pressure information storage unit 331 stores sensor IDs configured to identify the sensors 20, and the pressure information sent from the sensors 20 identified with the sensor IDs, in association with each other.

The accident information storage unit 332 stores the number of accidents which have occurred in the past in the areas where the multiple traffic signals 10 are installed. Specifically, the accident information storage unit 332 stores the accident information (see FIG. 3 which will be discussed later) including the number of accidents.

FIG. 3 illustrates an example of an accident information management table T1 configured to store the accident information. As illustrated in FIG. 3, the accident information management table T1 stores area IDs 301, as well as area ranges 302 and the numbers 303 of accidents each in association with the area IDs 301.

Each area ID 301 is information configured to identify an area (region) defined to manage the corresponding number 303 of accidents.

Each area range 302 is information configured to define the coverage of the corresponding area. As shown by examples in FIG. 3, each area range 302 is represented by the coordinates of the center of the corresponding area, and the radius from the coordinates of the center thereof. Incidentally, each area range 302 may be represented by the corresponding address like a ward name, a ward name with a district number, or the like, for example.

The number 303 of accidents is information on the number of accidents which have occurred within the corresponding area in the past (for example, for the past year).

The accident information stored in the accident information management table T1 is updated periodically by the controller 32.

The control server 40 includes a communication unit 41, a storage unit 42, and a controller 43.

The communication unit 41 is a communication interface for the control server 40. The communication unit 41 sends and receives various sets of information to and from the traffic signals 10 and the data server 30.

The storage unit 42 is formed from a hard disk drive (HDD) and the like. The storage unit 42 stores various programs, as well as various sets of information and the like to be used when the control server 40 performs processes.

Furthermore, the storage unit 42 stores a traffic signal management table T2 configured to manage the traffic signals 10, and a sensor management table T3 configured to manage the sensors 20.

FIG. 4 illustrates an example of the traffic signal management table T2. As illustrated in FIG. 4, the traffic signal management table T2 stores traffic signal IDs 401, as well as area IDs 402, sets of traffic signal position information 403, road IDs 404, group IDs 405, sensor IDs 406 and control modes 407 each in association with the traffic signal IDs 401.

Each traffic signal ID 401 is information configured to identify the corresponding traffic signal 10.

Each area ID 402 is information configured to identify an area (region) where the corresponding traffic signal 10 is installed. Incidentally, the area ID 402 is information similar to the area ID 301 configured to identify the area (region) included in the above-discussed accident information.

Each set of traffic signal position information 403 is information configured to indicate the position where the corresponding traffic signal 10 is installed. The set of traffic signal position information 403 is represented, for example, using the "latitude" and "longitude" of the traffic signal 10.

Each road ID 404 is information configured to identify the road R on which the corresponding traffic signal 10 is installed. For example, the road ID 404 is information configured to identify National Route 1 or the like on which the corresponding traffic signal 10 is installed.

Each group ID is information configured to identify a group for controlling the corresponding traffic signal 10. In this respect, the group may be defined arbitrarily. For example, the configuration may be such that: a predetermined traffic signal 10 of the multiple traffic signals 10 installed on a predetermined road (for example, a road whose road ID is L2) is defined as belonging to a certain group; and a group ID 405 is set to identify the certain group (for example, a group whose group ID is C2).

Each sensor ID 406 is information configured to identify a pressure sensor 20 installed at a stop position corresponding to the traffic signal 10.

Each control mode 407 is information configured to show how the corresponding traffic signal 10 is performing its display operation. Specifically, the control mode 407 is information configured to show how long the corresponding traffic signal 10 displays each color signal. Each control mode 407 represents one of the three modes, "A," "B," and "C."

As the control mode 407, the mode "B" is a mode defined as a reference. The mode "B" includes: a definition for a green signal time Bt (for example, 120 seconds); a definition for a yellow signal time Yt (for example, 10 seconds); a definition for a red signal time Rt (for example, 130 seconds); and a definition for a cycle time length Ct taken to complete a series of shifts from the green signal, the yellow signal to the red signal (for example, 260 seconds).

As the control mode 407, the mode "A" is a mode in which the green signal time Bt is set shorter than in the mode "B." The mode "A" includes: a definition for a green signal time Bt (for example, 110 seconds); a definition for a yellow signal time Yt (for example, 10 seconds); a definition for a red signal time Rt (for example, 140 seconds); and a definition for a cycle time length Ct taken to complete a series of shifts from the green signal, the yellow signal to the red signal (for example, 260 seconds).

As the control mode 407, the mode "C" is a mode in which the green signal time Bt is set longer than in the mode "B." The mode "C" includes: a definition for a green signal time Bt (for example, 130 seconds); a definition for a yellow signal time Yt (for example, 10 seconds); a definition for a red signal time Rt (for example, 120 seconds); and a definition for a cycle time length Ct taken to complete a series of shifts from the green signal, the yellow signal to the red signal (for example, 260 seconds).

It should be noted that in the embodiment, no matter which of the modes "A," "B," and "C" the control mode 407 is classified into, no change is made to the yellow signal time Yt (for example, 10 seconds), or the cycle time length Ct taken to complete a series of shifts from the green signal, the yellow signal to the red signal (for example, 260 seconds).

Furthermore, FIG. 5 illustrates an example of the sensor management table T3. As illustrated in FIG. 5, the sensor management table T3 stores sensor IDs 501, as well as sets of sensor position information 502 and road IDs 503 both in association with the sensor IDs 501. Incidentally, each sensor ID 501 is information which is the same as the corresponding sensor ID 406 illustrated in FIG. 4, and each road ID 503 is information which is the same as the corresponding road ID 404 illustrated in FIG. 4.

Each set of sensor position information 502 is information configured to indicate the center position of the stop position where the corresponding sensor 20 is installed.

The controller 43 controls the operation of each unit in the control server 40. The controller 43 is configured including a CPU, a RAM, a ROM and the like. The controller 43 implements a control function using the CPU which reads a control program.

In addition, the controller 43 functions as a pressure information obtainer 431, an abrupt braking information obtainer 432, and a traffic signal controller 433.

The controller 43 functions as the pressure information obtainer 431 to obtain the pressure information from the data server 30, and to store the obtained pressure information in the storage unit 42.

The controller 43 functions as the abrupt braking information obtainer 432 to obtain abrupt braking information indicating abrupt braking operations of the vehicle M running on the road R, based on the pressure information which is obtained by the pressure information obtainer 431 and is stored in the storage unit 42. Thereafter, the abrupt braking information obtainer 432 stores the obtained abrupt braking information in the storage unit 42. Incidentally, details of the abrupt braking information will be described later (see step S102 and FIG. 6).

The controller 43 functions as the traffic signal controller 433 to generate controls signals for controlling the multiple traffic signals 10, based on the abrupt braking information which is obtained by the abrupt braking information obtainer 432 and is stored in the storage unit 42. Specifically, the traffic signal controller 433 generates the control signals for controlling the multiple traffic signals 10 using one of the modes "A," "B," and "C" as the corresponding control mode 407, and sends the control signals to the traffic signals 10.

It should be noted that via a network, the above-discussed control system 1 performs: communications between the external server 500 and the data server 30; communications between the pressure sensors 20 and the data server 30; communications between the data server 30 and the control server 40; and communications between the control server 40 and the traffic signals 10. Incidentally, the lines for the network may be dedicated lines or public lines, and are not specifically limited. In addition, the communication method for the network may be a wireless communication or a wired communication.

How the Control System 1 Works

Figure 6:
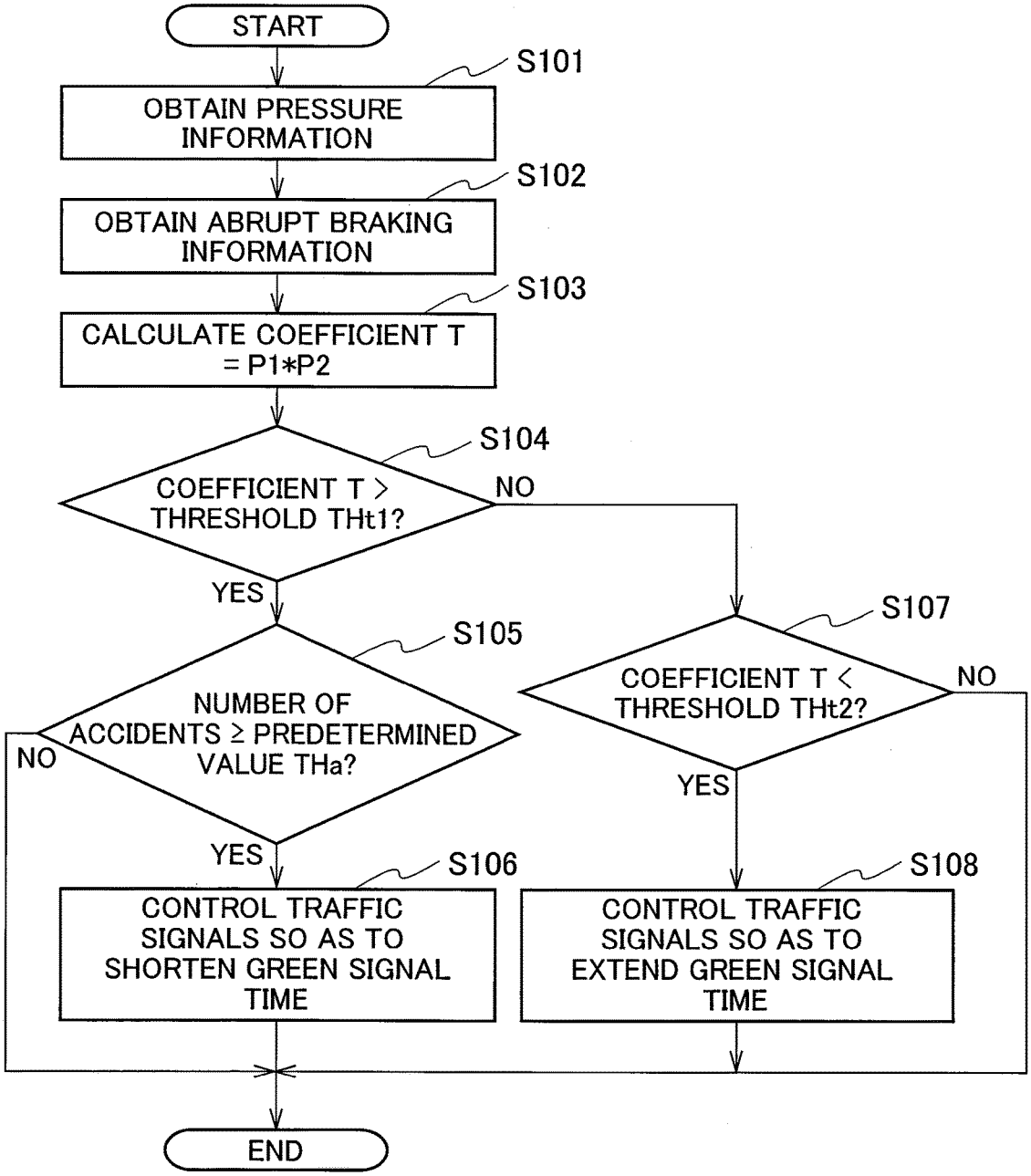
FIG. 6 is a flowchart illustrating how the control system according to the first embodiment of the present invention works.

Next, descriptions will be provided for how the control system 1 works. FIG. 6 is a flowchart illustrating how the control system 1 works to control the traffic signals 10. Incidentally, the following descriptions will be provided for an example of how the controller 43 works to control the traffic signal 10*a* and the traffic signal 10*b* (for the positional relationship among the traffic signals 10*a*, 10*b* and the pressure sensors 20*a*, 20*b*, see FIG. 1).

In the control server 40, the controller 43 functions as the pressure information obtainer 431 to obtain the pressure information from the data server 30 (step S101). Specifically, the pressure information obtainer 431 instructs the data server 30 to send to the pressure information obtainer 431 the pressure information which is received from the pressure sensors 20*a*, 20*b* installed corresponding to the traffic signals 10*a*, 10*b*.

Upon reception of this instruction, the data server 30 sends the control server 40 the pressure information including the pressure values which have been measured by the pressure sensors 20*a*, 20*b* for a predetermined time length (for example, one minute) and have been stored in the pressure information storage unit 331.

In this manner, the pressure information obtainer 431 obtains the pressure information stored in the pressure information storage unit 331. Thereby, the pressure information obtainer 431 stores the obtained pressure information in the storage unit 42.

The controller 43 functions as the abrupt braking information obtainer 432 to obtain the abrupt braking information indicating the abrupt braking operation, based on the pressure information obtained by the pressure information obtainer 431 and stored in the storage unit 42 (step S102). Specifically, the abrupt braking information obtainer 432 obtains the abrupt braking information which is the highest peak value among the values equal to or greater than a predetermined threshold THp in the pressure information, and stores the obtained abrupt braking information in the storage unit 42. Incidentally, the predetermined threshold THp is a threshold for detecting abrupt braking operations from the pressure information, and a value set in advance.

FIG. 7 illustrates the pressure information outputted from the pressure sensor 20*a* installed corresponding to the traffic signal 10*a*. FIG. 7 exemplifies the pressure information including pressure values which have been measured for a predetermined time length t1.

As illustrated in FIG. 7, referring to the pressure information, the abrupt braking information obtainer 432 identifies waveform portions Sw1 to Sw3 which exceed the predetermined threshold THp. The abrupt braking information obtainer 432 obtains the highest peak value P1 in the waveform portions Sw1 to Sw3 as the abrupt braking information connected with the traffic signal 10*a*.

Similarly, the abrupt braking information obtainer 432 refers to the pressure information outputted from the pressure sensor 20*b* installed corresponding to the traffic signal 10*b*, and thereby obtains the abrupt braking information which is the highest peak value P2 among the values equal to or greater than the predetermined threshold THp.

The controller 43 functions as the traffic signal controller 433 to calculate a coefficient T by multiplying the peak value P1 by the peak value P2 (step S103).

The traffic signal controller 433 determines whether the coefficient T is greater than a threshold THt1 (step S104). Incidentally, the threshold THt1 is a value set in advance.

If the traffic signal controller 433 determines that the coefficient T is greater than the threshold THt1 ("Yes" in step S104), the traffic signal controller 433 refers to the accident information storage unit 332 (the accident information management table T1) in the data server 30, and thereby obtains the numbers 303 of accidents (step S105).

Specifically, the traffic signal controller 433 refers to the traffic signal management table T2 stored in the storage unit 42, and thereby identifies the area ID 402 (for example, "A2") stored in association with the traffic signal IDs 401 (for example, "12" and "13") of the respective traffic signals 10*a*, 10*b*.

Furthermore, the traffic signal controller 433 refers to the accident information management table T1 in the accident information storage unit 332 in the data server 30, and thereby the number 303 of accidents (for example, "5") stored in associated with the area ID 301 (for example, "A2").

Thereafter, the traffic signal controller 433 determines whether the obtained number 303 of accidents (for example, "5") is not less than a predetermined value THa. Incidentally, if the traffic signal controller 433 determines that the obtained number 303 of accidents is less than the predetermined value THa ("No" in step S105), the traffic signal controller 433 terminates its operation. In other words, the traffic signal controller 433 determines that the traffic signals 10 should not be controlled, and terminates its operation.

On the other hand, if the traffic signal controller 433 determines that the obtained number 303 of accidents (for example, "5") is equal to or greater than the predetermined value THa (for example, "4") ("Yes" in step S105), the traffic signal controller 433 controls the traffic signals 10*a*, 10*b* (step S106).

Specifically, referring to the traffic signal management table T2, the traffic signal controller 433 changes the control mode 407 (for example, the control mode "B") stored in association with the traffic signal IDs 401 (for example, "12" and "13") of the respective traffic signals 10*a*, 10*b* to the control mode (for example, the control mode "A") in which the green signal time is set shorter than in the control mode "B," and thereby controls the traffic signals 10*a*, 10*b*. In other words, the traffic signal controller 433 controls the traffic signals 10*a*, 10*b* so as to reduce the traffic volume by shortening the time length for which the vehicle M is allowed to proceed.

In addition, if the traffic signal controller 433 determines that the coefficient T is not greater than the predetermined threshold THt1 ("No" in step S104), the traffic signal controller 433 determines whether the coefficient T is less than a predetermined threshold THt2 (step S107). Incidentally, the predetermined threshold THt2 is a value set in advance, and is less than the predetermined threshold THt1.

Besides, if the traffic signal controller 433 determines that the coefficient T is not less than the predetermined threshold THt2 ("No" in step S107), the traffic signal controller 433 terminates its operation. In other words, the traffic signal controller 433 determines that the traffic signals 10 should not be controlled, and terminates its operation.

On the other hand, the traffic signal controller 433 determines that the coefficient T is less than the predetermined threshold THt2 ("Yes" in step S107), the traffic signal controller 433 refers to the traffic signal management table T2, and changes the control mode 407 (for example, the control mode "B") stored in association with the traffic signal IDs 401 (for example, "12" and "13") of the respective traffic signals 10*a*, 10*b* to the control mode (for example, the control mode "C") in which the green signal time is set longer than in the control mode "B." Thereby, the traffic signal controller 433 controls the traffic signals 10*a*, 10*b* (step S108). In other words, the traffic signal controller 433 controls the traffic signals 10*a*, 10*b* so as to increase the traffic volume by extending the time length for which the vehicle M is allowed to proceed.

In this way, the control system 1 controls the traffic signals 10. Incidentally, the control system 1 may be configured to perform the above-discussed operation in a predetermined cycle (for example, every month), or in accordance with an instruction to be inputted by the administrator.

Working and Effects

As discussed above, in the control server 40 included in the control system 1 according to the first embodiment of the present invention, the controller 43 functions as the pressure information obtainer 431 to obtain the pressure information outputted from the pressure sensors 20, and to store the obtained pressure information in the storage unit 42. Furthermore, the controller 43 functions as the abrupt braking information obtainer 432 to obtain the abrupt braking information based on the pressure information which is stored in the storage unit 42, and to store the abrupt braking information in the storage unit 42. Moreover, the controller 43 functions as the traffic signal controller 433 to control the multiple traffic signals 10 (for example, the traffic signals 10*a*, 10*b*) installed on the road R based on the abrupt braking information stored in the storage unit 42.

In this respect, in a case where the vehicle M performs an abrupt braking operation on the road R, a value representing the pressure applied by the vehicle M to the road R increases quickly. In addition, from the abrupt braking operation by the vehicle M running on the road R, it is estimated that a traffic accident was highly likely to occur. In other words, the control system 1 controls the traffic signals 10 using the abrupt braking information on the abrupt braking operation which actually occurs as information indicating that a traffic accident is more likely to occur.

Thereby, the traffic signals 10 can be controlled with the actual driving operation of the vehicle M, which was highly likely to cause a traffic accident, taken into consideration. For this reason, the occurrence of a traffic accident can be inhibited more effectively.

Furthermore, it is possible to prevent the control of the traffic signals 10 more than necessary, and accordingly to prevent the reduction in the traffic volume more than necessary. In other words, a smooth traffic can be secured.

Moreover, in the control system 1 of the first embodiment of the present invention, the accident information storage unit 332 stores the number 303 of accidents, and the traffic signal controller 433 controls the multiple traffic signals 10 in the case where the number 303 of accidents is equal to or greater than the predetermined value THa.

Thereby, since the traffic signal controller 433 controls the multiple traffic signals 10 in the case where the number 303 of accidents which have occurred in the past is equal to or greater than the predetermined value THa, the traffic signal controller 433 is capable of distinguishing and controlling the traffic signals 10 installed in an area where an traffic accident is highly likely to occur. Incidentally, although the accident information storage unit 332 has been explained as being stored in the storage unit 33 in the data server 30, the accident information storage unit 332 is not limited to being stored in the storage unit 33 therein, and may be stored in the storage unit 42 in the control server 40.

Modification 1

Next, descriptions will be provided for the control system 1 according to Modification 1 of the first embodiment of the present invention. Incidentally, the following descriptions will be provided with a focus put on what makes the control system 1 according to Modification 1 differ from that of the first embodiment.

In the above-discussed first embodiment, as illustrated in FIG. 3, the accident information includes the area IDs 301, the area ranges 302 and the numbers 303 of accidents. The accident information management table T1 stores these sets of information in association with one another.

In Modification 1, as illustrated in FIG. 8, the accident information further includes timings 304. An accident information management table T4 stores the sets of information including the timings 304 in association with one another.

As illustrated in FIG. 8, each timing 304 is information on timing when a corresponding accident counted in the number 303 of accidents occurred. The timing 304 includes months 304*a* and hours 304*b*.

The months 304*a* are represented by a three-month period such as "April to June" corresponding to the spring seasons. Incidentally, the months 304*a* are not limited to the three-month period, and may be represented by a one-month period, for example.

The hours 304*b* are represented by a two-hour period such as "7 o'clock to 9 o'clock." Incidentally, the hours 304*b* are not limited to the two-hour period, and may be represented by a one-hour period, for example.

Furthermore, the control system 1 according to Modification 1 performs the following operations in steps S105, S106.

Specifically, the traffic signal controller 433 determines whether the number 303 of accidents stored in association with the timing 304 corresponding to the current date and time is equal to or greater than the predetermined value THa (step S105). If the number 303 of accidents is equal to or greater than the predetermined value THa, the traffic signal controller 433 controls the multiple traffic signals 10 (step S106).

In the foregoing step S105, the traffic signal controller 433 refers to the traffic signal management table T2 stored in the storage unit 42, and thereby identifies the area ID 402 (for example, "A2") stored in association with the traffic signal IDs 401 (for example, "12" and "13") of the respective traffic signals 10*a* to 10*b*. The traffic signal controller 433 further obtains the current date and time (for example, "8 a.m. on May 5") from the internal clock.

In addition, the traffic signal controller 433 refers to the accident information management table T4 stored in the accident information storage unit 332 in the data server 30, and thereby obtains the area ID 301 (for example, "A2") as well as the number 303 of accidents (for example, "5") stored in association with the timing 304 (for example, "April to June" and "7 o'clock to 9 o'clock") corresponding to the current date and time (for example, "8 a.m. on May 5"). Thereafter, the traffic signal controller 433 determines whether the obtained number 303 of accidents (for example, "5") is equal to or greater than the predetermined value THa.

Furthermore, if the obtained number 303 of accidents is not less than the predetermined value THa ("Yes" in step S105), the traffic signal controller 433 controls the traffic signals 10 (step S106). In other words, the traffic signal controller 433 controls the traffic signals 10 so as to reduce the traffic volume.

As discussed above, in the control system 1 according to Modification 1, the accident information storage unit 332 stores the number 303 of accidents and the timing 304 of the occurrence of the accidents in association with each other, and the controller 43 functions as the traffic signal controller 433 to control the traffic signals 10 in the case where the number 303 of accidents stored in association with the timing 304 corresponding to the current date and time is equal to or greater than the predetermined value THa.

Thereby, the traffic signal controller 433 controls the traffic signals 10 in the case where the number 303 of accidents in the timing 304 of the occurrence of the accidents is equal to or greater than the predetermined value THa. For this reason, based on the timing 304 when the accidents occurred and the number 303 of accidents, the traffic signal controller 433 is capable of accurately distinguishing and controlling the traffic signals 10 near which an accident is more likely to occur.

Modification 2

Next, descriptions will be provided for the control system 1 according to Modification 2 of the first embodiment of the present invention. Incidentally, the following descriptions will be provided with a focus put on what makes the control system 1 according to Modification 2 differ from that of the first embodiment.

In the above-discussed first embodiment, the abrupt braking information obtainer 432 obtains the highest peak value among the values equal to or greater than the predetermined threshold THp in the pressure information as the abrupt braking information.

In the control system 1 according to Modification 2, the abrupt braking information obtainer 432 obtains integral values, which are equal to or greater than the predetermined threshold THp in the pressure information, as the abrupt braking information.

Figure 9:
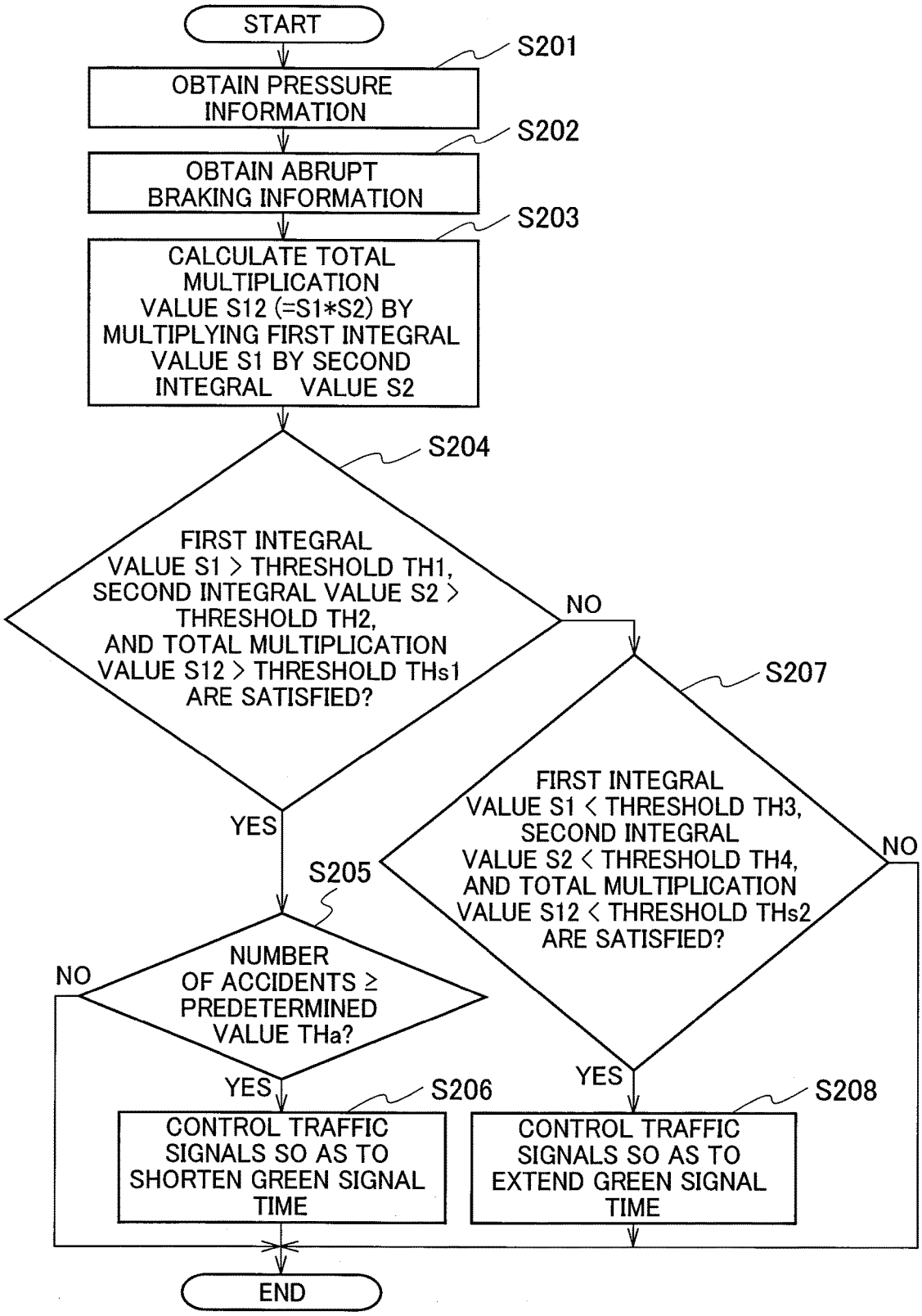
FIG. 9 is a flowchart illustrating how a control system according to the modification of the first embodiment of the present invention works.

FIG. 9 is a flowchart illustrating how the control system 1 according to Modification 2 works to control the traffic signals 10.

In the control server 40, the controller 43 functions as the pressure information obtainer 431 to obtain the pressure information from the data server 30 (step S201).

Referring to the pressure information, the abrupt braking information obtainer 432 identifies waveform portions Sw1 to Sw3 which exceed the predetermined threshold THp. As indicated with the shaded areas in FIG. 7, the abrupt braking information obtainer 432 further calculates integral values S1*a* to S1*c* of the respective waveform portions Sw1 to Sw3, and then obtains a first integral value S1, which is the sum of the calculated integral values S1*a* to S1*c*, as the abrupt braking information (step S202).

Similarly, referring to the pressure information outputted from the pressure sensor 20*b* installed corresponding to the traffic signal 10*b*, the abrupt braking information obtainer 432 calculates integral values which respectively represent waveform portions defined by the values equal to or greater than the predetermined threshold THp, and then obtains a second integral value S2, which is the sum of the calculated integral values, as the abrupt braking information (step S202).

The traffic signal controller 433 calculates a total multiplication value S12 by multiplying the first integral value S1 by the second integral value S2 (step S203).

The traffic signal controller 433 determines whether a relationship of the first integral value S1>a predetermined threshold TH1, a relationship of the second integral value S2>a predetermined threshold TH2, and a relationship of the total multiplication value S12>a predetermined threshold THs1 are satisfied (step S204). Incidentally, the predetermined threshold TH1, the predetermined threshold TH2, and the predetermined threshold THs1 are values set in advance.

If the traffic signal controller 433 determines that the above-mentioned relationships are satisfied ("Yes" in step S204), the traffic signal controller 433 refers to the accident information storage unit 332 in the data server 30, and thereby obtains the number 303 of accidents (step S205). Incidentally, the operations of steps S205, S206 are the same as those of steps S105, S106, and descriptions for them are omitted.

On the other hand, if the traffic signal controller 433 determines that the above-mentioned relationships are not satisfied ("No" in step S204), the traffic signal controller 433 determines whether the following relationships are satisfied (step S207). Specifically, the traffic signal controller 433 determines whether a relationship of the first integral value S1<a predetermined threshold TH3, a relationship of the second integral value S2<a predetermined threshold TH4, and a relationship of the total multiplication value S12<a predetermined threshold THs2 are satisfied.

Incidentally, the predetermined threshold TH3, the predetermined threshold TH4, and the predetermined threshold THs2 are values set in advance. Furthermore, the predetermined threshold TH3 is a value less than the predetermined threshold TH1, the predetermined threshold TH4 is a value less than the predetermined threshold TH2, and the predetermined threshold THs2 is a value less than the predetermined threshold THs1.

Furthermore, if the traffic signal controller 433 determines that the above-mentioned relationships are not satisfied ("No" in step S207), the traffic signal controller 433 terminates its operation.

On the other hand, if the traffic signal controller 433 determines that the above-mentioned relationships are satisfied ("Yes" in step S207), the traffic signal controller 433 performs the operation of step S208. Incidentally, the operation of step S208 is the same as that of step S108 discussed above, and descriptions for it is omitted.

As discussed above, in the control system 1 according to Modification 2, based on the pressure information, the abrupt braking information obtainer 432 obtains the sum of the integral values, which respectively represent the waveform portions defined by the values equal to or greater than the predetermined threshold THp, as the abrupt braking information. Thereby, based on the obtained abrupt braking information, the control system 1 according to Modification 2 is capable of controlling the traffic signals 10 with the actual driving operation of the vehicle M, which was highly likely to cause a traffic accident, taken into consideration. For this reason, the occurrence of a traffic accident can be inhibited more effectively.

Other Embodiments of the Present Invention

The present invention has been described in details using the foregoing embodiment. To those skilled in the art, it is clear that the present invention is not limited to the embodiment discussed in the specification.

For example, in the above-discussed embodiment, the control system 1 includes the two servers, namely, the data server 30 and the control server 40. Nevertheless, the configuration may be such that the control system 1 includes a single server. For example, the configuration may be such that the control system 1 includes a single server by providing the functions of the data server 30 to the control server 40.

Furthermore, for example, the above-discussed embodiment does not have to include the operation of step S105 or the operation of step S205. In the control system 1, the traffic signal controller 433 may be configured to control the traffic signals 10 without determining whether the number 303 of accidents is equal to or greater than the predetermined value.

For example, in the above-discussed embodiment, the three modes "A," "B," and "C" are defined to classify each control mode 407. Nevertheless, more than three modes may be defined by changing at least one of: the green signal time Bt; the yellow signal time Yt; and red signal time Rt.

As discussed above, the present invention is not limited to the foregoing embodiment as it is. The present invention may be embodied by modifying components within the scope not departing from the gist of the present invention. Furthermore, various inventions can be made by appropriately combining some of the components disclosed in the foregoing embodiment. For example, inventions may be made by eliminating some components from all the components disclosed in the embodiment.

What is claimed is:

1. A control server configured to control a plurality of traffic signals installed on a road, comprising:

a controller, wherein the controller functions as:

a pressure information obtainer configured to obtain pressure information which is output from a pressure sensor installed at a stop position on the road corresponding to each of the plurality of traffic signals, and which includes a value representing pressure received from a vehicle running on the road, and configured to store the pressure information in a storage unit; and a braking information obtainer configured to, based on the pressure information stored in the storage unit, obtain braking information on a braking operation performed by the vehicle running on the road, and configured to store the braking information in the storage unit; and a traffic signal controller configured to, based on the braking information stored in the storage unit, generate a control signal for controlling the plurality of traffic signals; and an accident information storage unit configured to store the number of accidents which have occurred in the past in an area where any of the plurality of traffic signals are installed, and further configured to store the number of accidents and timing of occurrence of the accidents in association with each other;

wherein the controller functions as the traffic signal controller to generate the control signal for controlling the plurality of traffic signals in a case where the number of accidents, stored in association with the timing corresponding to a range of dates and a period of time within the range of dates, is equal to or greater than a predetermined value.

2. A control system comprising:

a data server configured to obtain pressure information, which includes a value representing pressure received from a vehicle running on a road, from a pressure sensor installed in a stop position on the road corresponding to each of a plurality of traffic signals;

a control server configured to:

obtain the pressure information from the data server;

based on the pressure information, obtain braking information on a braking operation performed by the vehicle running on the road; and based on the braking information, generate a control signal for controlling the plurality of traffic signals; and an accident information storage unit configured to store the number of accidents which have occurred in the past in an area where any of the plurality of traffic signals are installed, and further configured to store the number of accidents and timing of occurrence of the accidents in association with each other;

wherein the control server functions as a traffic signal controller to generate the control signal for controlling the plurality of traffic signals in a case where the number of accidents, stored in association with the timing corresponding to a range of dates and a period of time within the range of dates, is equal to or greater than a predetermined value.

3. A control system configured to control a plurality of traffic signals installed on a road, comprising:

a plurality of pressure sensors installed at stop positions on the road corresponding to the plurality of traffic signals, and configured to output pressure information which includes a value representing pressure received from a vehicle running on the road;

a control server, wherein the control server functions as:

a pressure information obtainer configured to obtain the pressure information, and to store the pressure information in a storage unit;

a braking information obtainer configured to, based on the pressure information stored in the storage unit, obtain braking information on a braking operation performed by the vehicle running on the road, and configured to store the braking information in the storage unit; and a traffic signal controller configured to, based on the braking information stored in the storage unit, generate a control signal for controlling the plurality of traffic signals; and an accident information storage unit configured to store the number of accidents which have occurred in the past in an area where any of the plurality of traffic signals are installed, and further configured to store the number of accidents and timing of occurrence of the accidents in association with each other;

wherein the control server functions as the traffic signal controller to generate the control signal for controlling the plurality of traffic signals in a case where the number of accidents, stored in association with the timing corresponding to a range of dates and a period of time within the range of dates, is equal to or greater than a predetermined value.

* * * * *